US011753845B2

(12) United States Patent
Potts et al.

(10) Patent No.: US 11,753,845 B2
(45) Date of Patent: Sep. 12, 2023

(54) MOBILE ANTI-SCALE WALL SYSTEM AND METHOD OF MAKING AND USING THE SAME

(71) Applicants: Cole G. Potts, La Mesa, NM (US); Lindsey J. Potts, La Mesa, NM (US)

(72) Inventors: Cole G. Potts, La Mesa, NM (US); Lindsey J. Potts, La Mesa, NM (US)

( * ) Notice: Subject to any disclaimer, the term of this patent is extended or adjusted under 35 U.S.C. 154(b) by 191 days.

(21) Appl. No.: 17/495,352

(22) Filed: Oct. 6, 2021

(65) Prior Publication Data

US 2022/0120110 A1 Apr. 21, 2022

Related U.S. Application Data

(60) Provisional application No. 63/093,330, filed on Oct. 19, 2020.

(51) Int. Cl.
*E04H 17/00* (2006.01)
*E04H 17/18* (2006.01)

(52) U.S. Cl.
CPC ..... *E04H 17/003* (2013.01); *E04H 17/18* (2013.01)

(58) Field of Classification Search
CPC ..... E04H 17/003; E04H 17/009; E04H 17/14; E04H 17/16; E04H 17/18; E04H 17/185; E01F 13/022
See application file for complete search history.

(56) References Cited

U.S. PATENT DOCUMENTS

| | | | | |
|---|---|---|---|---|
| 10,427,916 | B1 * | 10/2019 | Fisher | B66C 23/36 |
| 10,689,819 | B2 * | 6/2020 | Neusch | E01F 15/0461 |
| 11,105,116 | B1 * | 8/2021 | Fisher | E04H 17/24 |
| 2002/0121063 | A1 * | 9/2002 | Mathias | E04B 2/7425 52/578 |
| 2018/0347227 | A1 * | 12/2018 | Neusch | E04H 17/009 |
| 2022/0325485 | A1 * | 10/2022 | Neusch | E01F 13/12 |

FOREIGN PATENT DOCUMENTS

| | | | | |
|---|---|---|---|---|
| CA | 2505076 | A1 * | 6/2006 | E04H 17/16 |
| DE | 19511906 | A1 * | 10/1996 | E04G 21/3214 |
| DE | 202012102491 | U1 * | 11/2012 | E01F 13/022 |

(Continued)

*Primary Examiner* — Jonathan P Masinick
(74) *Attorney, Agent, or Firm* — Edmund P. Anderson; North Star IP Law PLLC

(57) ABSTRACT

A mobile anti-scale wall section comprises a plurality of spaced apart longitudinally-extending wall members, each having a lower wall end, an upper wall end; an outwardly facing anti-scale plate comprising an anti-scale plate height and anti-scale plate width and attached to and joining the wall members proximate their upper ends; a laterally-extending base plate comprising an outer end and an opposed inner end, the base plate; a plurality of spaced apart, longitudinally-extending receiving members corresponding to the wall members, each having an upper receiving end and a lower receiving end that is attached to the base plate proximate the outer end, each upper receiving end configured to receive a corresponding lower wall end in inserted engagement; and a longitudinally-extending kick plate comprising a kick plate height and a kick plate width disposed on the base plate proximate the outer end and attached to the receiving members and/or the base plate.

21 Claims, 13 Drawing Sheets

(56) References Cited

FOREIGN PATENT DOCUMENTS

| | | | | | |
|---|---|---|---|---|---|
| DE | 202015002809 | U1 | * | 6/2015 | ..... E01F 13/022 |
| DE | 202015101002 | U1 | * | 6/2015 | ..... E04H 17/14 |
| DE | 102015107273 | B3 | * | 10/2016 | |
| DE | 202017003696 | U1 | * | 11/2017 | ..... B65D 61/00 |
| DE | 202020004653 | U1 | * | 1/2021 | |
| EP | 1624138 | A1 | * | 2/2006 | ..... E04H 17/003 |
| EP | 3130706 | A1 | * | 2/2017 | |
| FR | 2696491 | A1 | * | 4/1994 | ..... E01F 13/022 |
| FR | 2903719 | A1 | * | 1/2008 | ..... E04H 17/1426 |
| GB | 2360531 | A | * | 9/2001 | ..... E01F 13/022 |
| GB | 2458312 | A | * | 9/2009 | ..... E04H 12/2215 |
| GB | 2564462 | A | * | 1/2019 | ..... E04H 17/14 |
| WO | WO-2013157923 | A1 | * | 10/2013 | ..... E01F 13/022 |

* cited by examiner

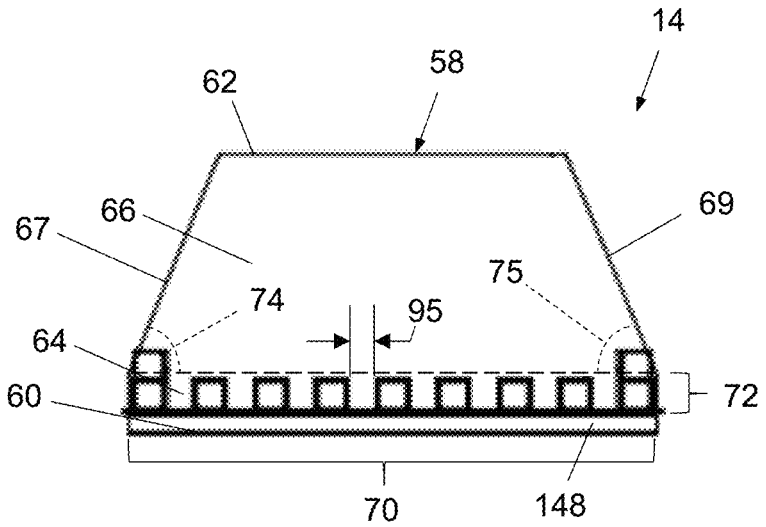
FIG. 4
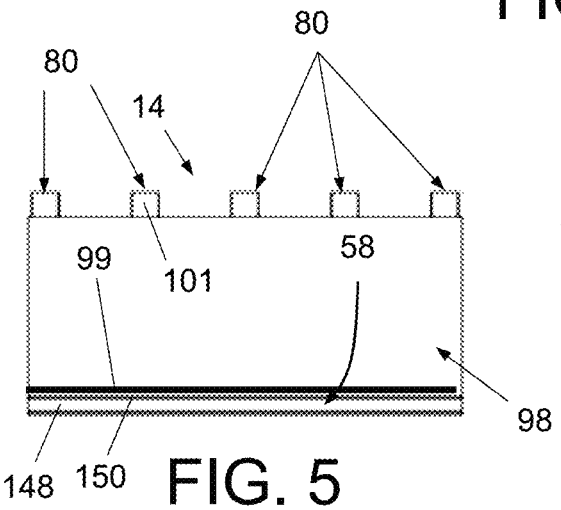
FIG. 5
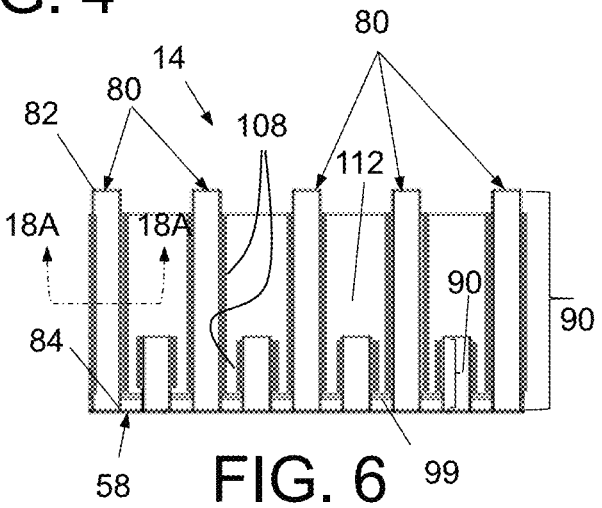
FIG. 6
| ITEM NO. | PART | TOTAL WEIGHT (lbs) | QTY. |
|---|---|---|---|
| 1 | 4.5 inch x 3 Foot Tube | 160.5 | 5 |
| 2 | Riot Base Plate | 260.1 | 1 |
| 3 | Kick Plate | 242.0 | 1 |
| 4 | 4.5 inch x 1 Foot Tube | 42.8 | 4 |
| 5 | 4x4x16 Foot Tube | 1758.3 | 9 |
| 6 | Anti Climb Plate | 244.8 | 1 |
| Total Weight | | 2708.5 | |
| 8 | Lift Lug | | 2 |
| 9 | 4x4x1 foot Tube - | | 2 |
FIG. 7

MOBILE ANTI-SCALE WALL SYSTEM AND METHOD OF MAKING AND USING THE SAME

CROSS REFERENCE TO RELATED APPLICATIONS

This application claims priority to U.S. Provisional Patent Application No. 63/093,330 filed on Oct. 19, 2020, the contents of which are incorporated herein by reference in their entirety.

FIELD OF THE INVENTION

The subject invention relates generally to a mobile anti-scale wall system and method of making and using, and more particularly to a modular mobile anti-scale wall system and method of making and using that comprises a plurality of vertically-extending bollards and a counterweight.

BACKGROUND

Various combinations of temporary and portable fences and barricades have been used to temporarily limit the access of crowds and vehicles to public and private buildings and other areas, such as public squares, parks, and other areas. These temporary and portable fences and barricades are frequently used to define a protective perimeter around the areas described in conjunction with events that draw large crowds of people, including large sporting events, marches, protests, and periods of public unrest. Various types and combinations of portable chain link and mesh fences and barricades have been used in the past, but the widespread availability of a portable power tools, such as portable power saws, drills, grinders, and the like, as well as various types of portable gas torches and other cutting tools, as well as the temporary and portable nature and construction of the fences and barricades themselves, have rendered these types of fences and barricades easily susceptible to significant damage or defeat resulting in breaches of the perimeter and significant harm and damage to both people and property within the perimeter, including vandalism, burning, and looting of the properties within the perimeter, and assault and death of people housed or working therein. In addition, chain link fences in particular can be easily scaled and thus defeated, and the use of various forms of outwardly extending barbed and concertina wires at the top of these fences to limit scaling or climbing may be easily defeated and are often visually undesirable in many settings. These temporary and portable fences and barricades are also easily susceptible to damage and defeat by the use of various automotive vehicles, such as cars and trucks.

Therefore, it is very desirable to provide a mobile wall system that provides a secure perimeter without the limitations of prior art fences and barricades and may be quickly and easily assembled for various events as needs arise and may also be quickly and easily disassembled and stored once the needs have passed.

SUMMARY OF THE INVENTION

In one embodiment, a mobile anti-scale wall section is disclosed, comprising: a plurality of spaced apart longitudinally-extending wall members, each having a lower wall end, an upper wall end, a wall member width, and a length, the wall members configured for placement in a substantially vertical position; an outwardly facing anti-scale plate comprising an anti-scale plate height and an anti-scale plate width and attached to the plurality of spaced apart, longitudinally-extending wall members proximate their upper ends and joining the wall members to one another; a laterally-extending base plate comprising an outer end and an opposed inner end, the base plate configured for placement in a substantially horizontal position and configured to support the wall members and anti-scale plate; a plurality of spaced apart, longitudinally-extending receiving members corresponding to the plurality of spaced apart, longitudinally-extending wall members, each having an upper receiving end and a lower receiving end that is attached to the base plate proximate the outer end, each upper receiving end configured to receive a corresponding lower wall end in inserted engagement; and a longitudinally-extending kick plate comprising a kick plate height and a kick plate width disposed on the base plate proximate the outer end and attached to the receiving members and/or the base plate.

In another embodiment, a method of making a mobile anti-scale wall section is disclosed, comprising: forming a wall member module comprising: a plurality of spaced apart longitudinally-extending wall members, each having a lower wall end, an upper wall end, a wall member width, and a length, the wall members configured for placement in a substantially vertical position; and an outwardly facing anti-scale plate comprising an anti-scale plate height and an anti-scale plate width and attached to the plurality of spaced apart, longitudinally-extending wall members proximate their upper ends and joining the wall members to one another; forming base module comprising: a laterally-extending base plate comprising an outer end and an opposed inner end, the base plate configured for placement in a substantially horizontal position and configured to support the wall members and anti-scale plate; a plurality of spaced apart, longitudinally-extending receiving members corresponding to the plurality of spaced apart, longitudinally-extending wall members, each having an upper receiving end and a lower receiving end that is attached to the base plate proximate the outer end, each upper receiving end configured to receive a corresponding lower wall end in inserted engagement; and a longitudinally-extending kick plate comprising a kick plate height and a kick plate width disposed on the base plate proximate the outer end and attached to the receiving members and/or the base plate; raising the wall member module into a vertical position with the lower wall ends disposed downwardly; and lowering the wall member module while inserting the corresponding lower wall ends and wall members of the wall member module into the receiving ends and receiving members of the base module into inserted engagement to form the mobile anti-scale wall section.

A method of using a mobile anti-scale wall section to form a mobile anti-scale wall is disclosed, comprising: forming a plurality of mobile anti-scale wall sections, each comprising: forming a wall member module comprising: a plurality of spaced apart longitudinally-extending wall members, each having a lower wall end, an upper wall end, a wall member width, and a length, the wall members configured for placement in a substantially vertical position; and an outwardly facing anti-scale plate comprising an anti-scale plate height and an anti-scale plate width and attached to the plurality of spaced apart, longitudinally-extending wall members proximate their upper ends and joining the wall members to one another; forming base module comprising: a laterally-extending base plate comprising an outer end and an opposed inner end, the base plate configured for placement in a substantially horizontal position and configured to support the wall members and anti-scale plate; a plurality of spaced apart, longitudinally-extending receiving members corresponding to the plurality of spaced apart, longitudinally-extending wall members, each having an upper receiving end and a lower receiving end that is attached to the base plate proximate the outer end, each upper receiving end configured to receive a corresponding lower wall end in inserted engagement; and a longitudinally-extending kick plate comprising a kick plate height and a kick plate width disposed on the base plate proximate the outer end and attached to the receiving members and/or the base plate; raising the wall member module into a vertical position with the lower wall ends disposed downwardly; lowering the wall member module while inserting the corresponding lower wall ends and wall members of the wall member module into the receiving ends and receiving members of the base module into inserted engagement to form the mobile anti-scale wall section comprising a first end and an opposed second end; arranging the plurality of mobile anti-scale wall sections facing outwardly as each is formed with the first ends and opposing second ends of respective adjoining wall sections abutting one another to define a predetermined perimeter shape; and disposing a plurality of counterweights on upper surfaces of the base plates inwardly of their receiving members, each comprising a weight configured to fix the mobile anti-scale wall sections in upright positions with the wall members in a substantially vertical positions and in inserted engagement in the receiving members, the mobile anti-scale wall sections and counterweights comprising a mobile anti-scale wall comprising the predetermined perimeter shape.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which:

FIG. 4 is a top view of the embodiment of the lower or base module of FIGS. 1 and 2, for example;

FIG. 5 is a front or outer view of the embodiment of the lower or base module of FIG. 4;

FIG. 6 is a rear or inner view of the embodiment of the lower or base module of FIG. 4;

FIG. 7 is a table listing the component and component characteristics of an embodiment of the components of the mobile anti-scale wall system;

DESCRIPTION OF THE EMBODIMENTS

Figure 1:
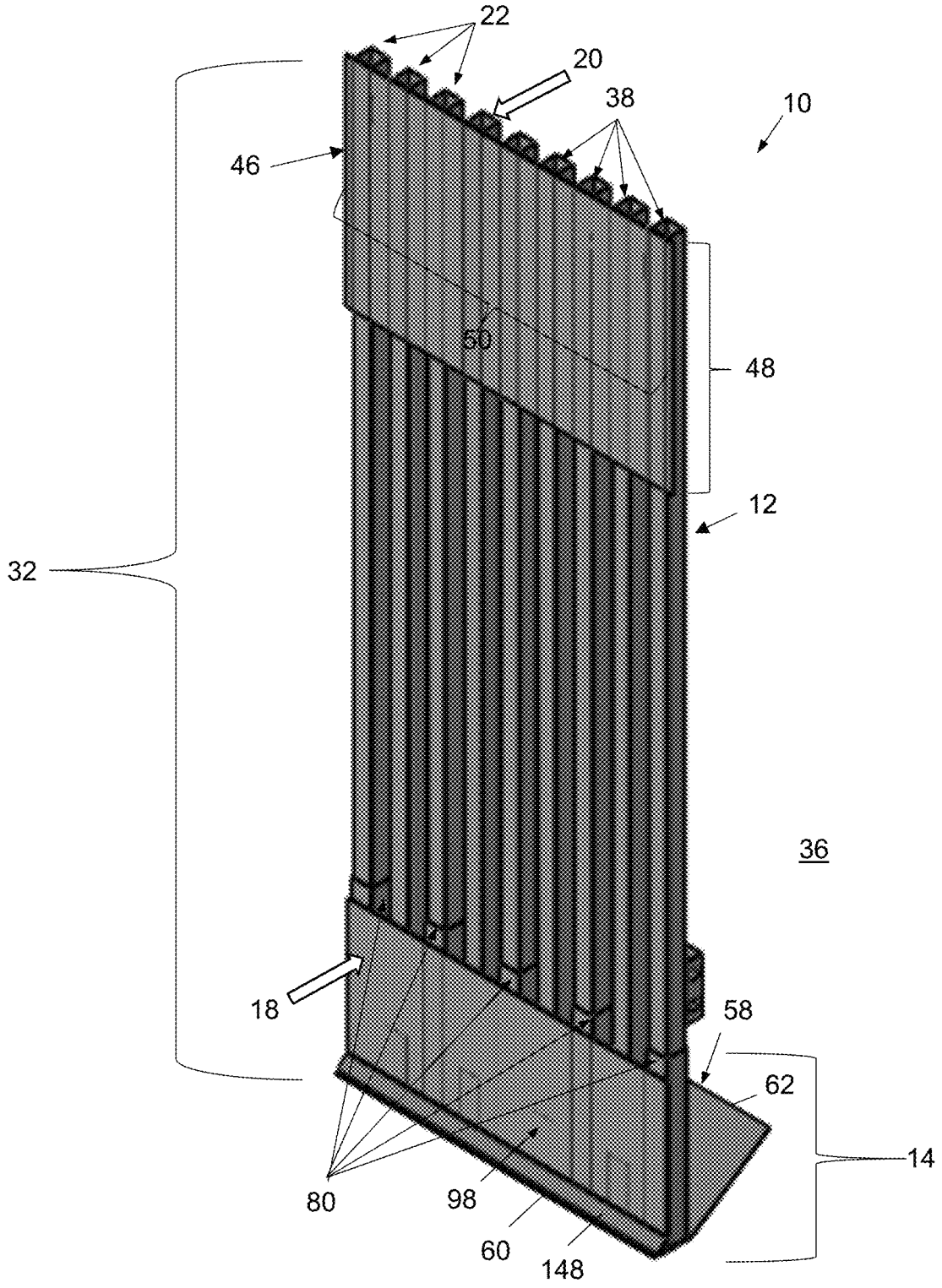
FIG. 1 is a front or outer perspective view of an embodiment of a mobile anti-scale wall section configured for use in a mobile anti-scale wall system, as described herein, and comprising an assembly of an upper or wall member module and a lower or base module.

The mobile anti-scale wall system and wall sections disclosed herein, as well as the method of making and using the same, provide a mobile wall system that is configured to provide a secure perimeter without the limitations of prior art fence and barricade systems. The mobile anti-scale wall system disclosed herein may be quickly and easily assembled for various events as needs arise and may also be quickly and easily disassembled and stored once the needs have passed using the method of making and using the same described herein. The mobile anti-scale wall system provides a secure perimeter that is highly resistant to breach by pressing through and between the wall members by individuals or crowds of individuals because the predetermined spacing of the wall members is selected to be smaller than the width of the smallest person, even children capable of walking, that could provide a threat to the persons or property housed within the predetermined perimeter, and the wall members, such as metal tubes, are selected to provide a stiffness that cannot be easily spread apart by a human being even with various mechanical aides or portable power tools. The mobile anti-scale wall system is also highly resistant to scaling by individuals or crowds of individuals because a predetermined height of the wall members is selected to ensure that the upper end of the wall members cannot be reached by persons jumping from the ground without the use of external climbing or jumping devices including ropes, ladders, trampolines, and the like, and is highly resistant to being scaled by shinnying up the wall members due to the presence of the anti-scaling plate that has a predetermined anti-scale plate height that is greater than the reach (i.e. torso and arm length) of a majority of adult humans that have a body size and strength (i.e. a combination of leg width, arm and body strength, etc.) that makes them capable of shinnying up the wall members. In addition, the wall members may be coated with various lubricants and coatings that are heat and flame retardant/resistant and that reduce the coefficient of sliding friction, thereby further enhancing the anti-scale resistance of the wall members and associated wall sections.

The mobile anti-scale wall system and wall sections disclosed herein are also highly resistant to breach by many types of automotive vehicles, including passenger car and trucks and as well as most light duty commercial trucks. In one embodiment, the mobile anti-scale wall system and wall members comprise metal tubes, such as rounded rectangular and circular cross-section steel tubes, that together with the counterweights and connectors act as bollards to resist breach by the vehicles described above.

The methods of making and using the mobile anti-scale wall system described herein can be used to quickly establish a protective perimeter around an area or buildings in response to public unrest or riots due to the modular construction of the wall member modules, base modules, and counterweights and the ability to use various trucks to move them to a predetermined location that requires the establishment of a predetermined perimeter and mobile cranes, lift trucks, and other lifting equipment to assemble adjoining wall sections and place counterweights on them to provide a mobile wall and enclose and establish a predetermined perimeter to protect occupants, equipment, buildings, and other items enclosed therein.

The mobile anti-scale wall system does not comprise chain link or metal mesh fencing, and does not require or comprise barbed, razor, concertina, or other wire to provide a predetermined protective perimeter.

As used herein, the terms front or forward or outside and rear or rearward or aft or inside refer to the front or rear of the wall system or a wall section(s), respectively, and toward an area in front of the wall and outside the predetermined perimeter and to an area that is to the rear of or behind the wall and inside or within the predetermined perimeter, or to a direction toward the front or rear of the wall, respectively. The term longitudinal or along the length refers to a direction that extends along or generally parallel to an article, or from one end to an opposed end. The term lateral or along the width or left-right refers to a direction that is orthogonal, or substantially orthogonal, to the longitudinal direction. The terms up or upward or down or downward refer to the top or bottom of the article or wall system or section, or to a direction substantially toward the top or bottom of the article or wall, respectively, particularly with reference to the surface of the earth or ground. The terms in or inner or inward refer to a direction toward the rear of the wall and inside the predetermined perimeter and within an area enclosed by the predetermined perimeter, and out or outer or outward refers to the opposite direction toward the front of the wall and outside the predetermined perimeter and outside the area enclosed by the predetermined perimeter.

Referring to FIGS. 1-19C, and more particularly FIGS. 1-6 and 8-14, in one embodiment a mobile anti-scale wall section 10 is disclosed that comprises an assembly of a wall member module 12 that is inserted into, engages, rests within, and is supported by a base module 14, as each are described herein. In one embodiment, the mobile anti-scale wall section 10 further comprises a counterweight 16 for the wall section that is configured to at least exceed and overbalance the weight of the wall member module and the base module in view of their physical configurations and the potential upward or lifting/tipping forces associated with lateral forces that may be applied to front side 18 or rear side 20 of the mobile anti-scale wall section 10 by an individual or crowd of individuals, an automotive vehicle, natural causes such as wind, flood waters, or the like, or a combination thereof. While the mobile anti-scale wall section 10 may be formed in one embodiment using modular construction and the modules as described herein, the mobile anti-scale wall section 10 may also be assembled in various other embodiments in any suitable form or order of assembly of the constituent components and their attachments as described herein.

Figure 3A:
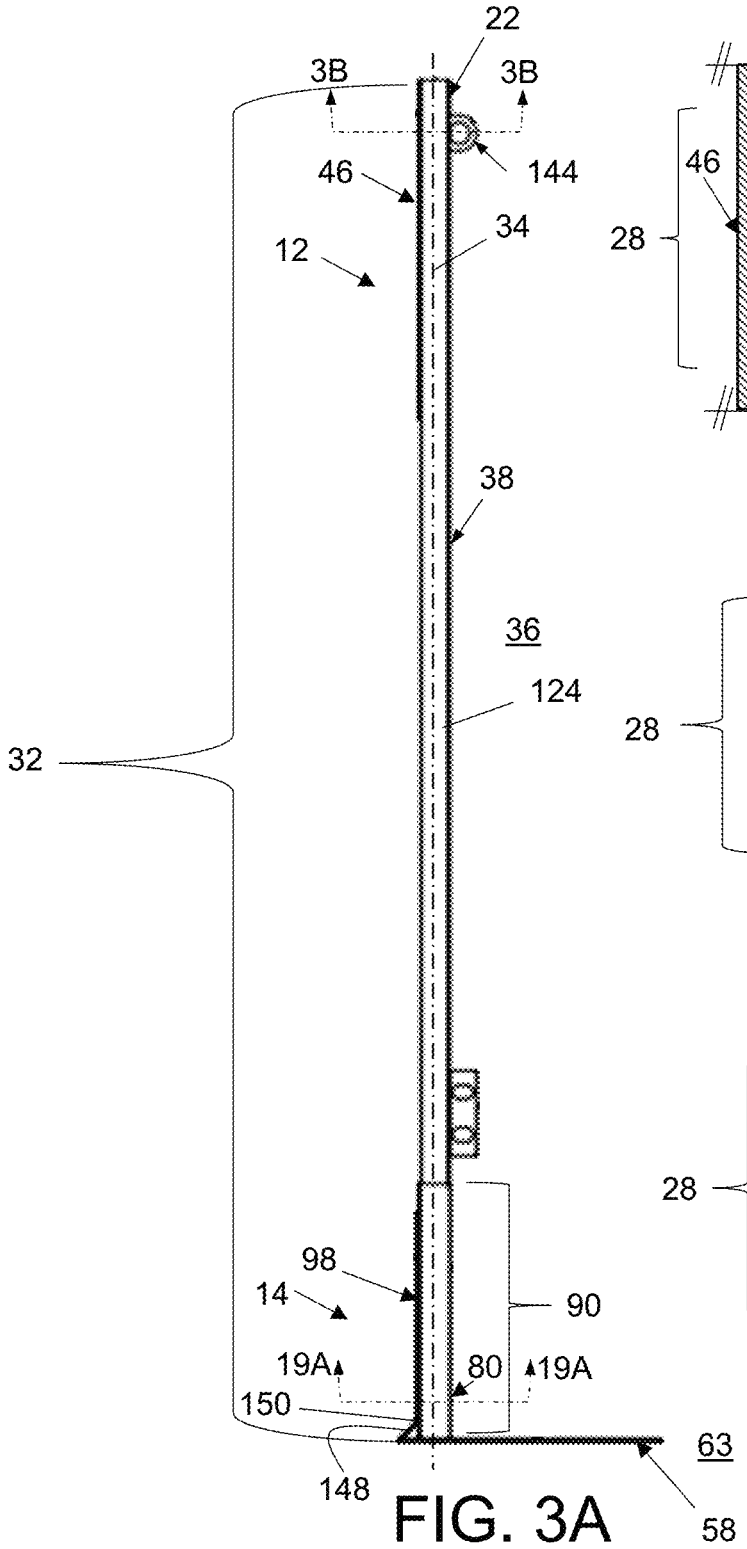
FIG. 3A is a right side view of the embodiment of FIG. 1.
Figure 3B:
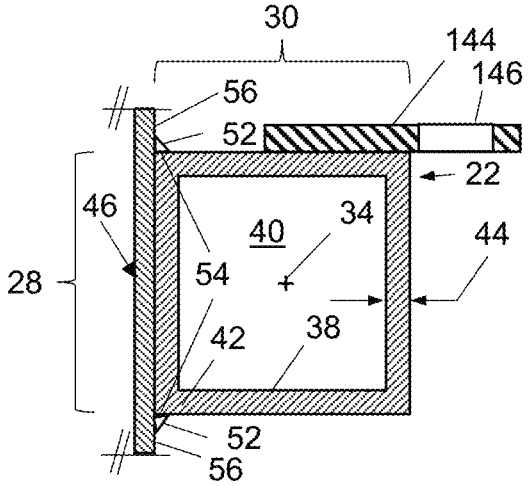
FIG. 3B is a section view of the embodiment of FIG. 3A taken along section 3B-3B.
Figure 3C:
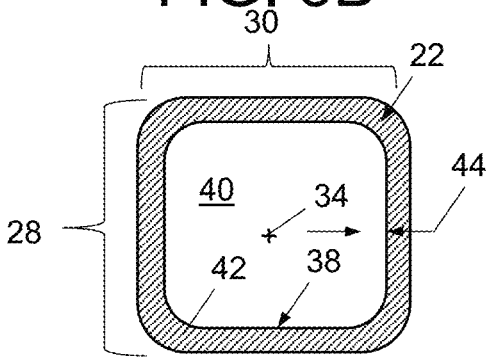
FIG. 3C is a section view of an alternate embodiment of FIG. 3A comprising wall members and receiving members comprising rounded rectangular cross-sectional shapes.
Figure 3D:
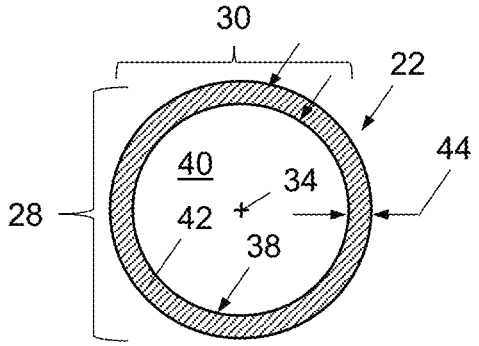
FIG. 3D is a section view of another alternate embodiment of FIG. 3A comprising wall members and receiving members comprising circular cross-sectional shapes.

In one embodiment, the mobile anti-scale wall section 10 and wall member module 12 comprises a plurality of spaced apart longitudinally-extending wall members 22, each having a lower wall member end 24, an upper wall member end 26, a wall member width 28 that faces forward/rearward, wall member depth 30 that faces the left/right side or end/opposed end of the wall section, and a wall member length 32 that extends along longitudinal axis 34, the wall members configured for placement in a substantially vertical position 36. The plurality of spaced apart longitudinally-extending wall members 22 may comprise any suitable wall members formed from any suitable wall member material. In one embodiment, the longitudinally-extending wall members 22 comprise longitudinally-extending hollow metal wall member tubes 38, such as tubes formed from various metal alloys, including various alloys of steel, including alloys of carbon or stainless steel, aluminum, or magnesium that have been given various combinations of heat and/or mechanical forming treatments to achieve predetermined microstructural, mechanical, chemical or physical properties, including, for example, a predetermined yield strength, ultimate tensile strength, and/or hardness. In one embodiment, the plurality of spaced apart longitudinally-extending wall members 22 may be formed from the same material as the other components of the anti-scale wall section 10 and/or the wall member module 12. The longitudinally-extending hollow metal wall member tubes 38 may have any suitable lateral cross-sectional configuration 40 as illustrated in FIGS. 3B-3D including, for example, rectangular (FIG. 3B), rounded rectangular (FIG. 3C), or circular (FIG. 3D) cross-sectional configurations. The longitudinally-extending hollow metal tubes 34 comprise a peripheral tube wall 42 that may have any suitable wall thickness 44, which in various embodiments may comprise a range from 0.03-1.0 inches, more particularly a range from 0.05-0.75 inches, and even more particularly a range from 0.10-0.50 inches. In one embodiment, the wall member 22 comprises a steel alloy and the wall thickness 44 comprises 0.125 inches as set forth in FIG. 7. The wall member width 28 may comprise any suitable width, which in various embodiments may comprise a range from 3-9 inches, more particularly a range from 3-7 inches, and even more particularly a range from 3-5 inches. In one embodiment, the wall member 22 comprises a rectangular lateral cross-sectional configuration 40 and the wall member width 28 comprises 4 inches as set forth in FIG. 7. The wall member depth 30 may comprise any suitable depth, which in various embodiments may comprise a range from 3-9 inches, more particularly a range from 3-7 inches, and even more particularly a range from 3-5 inches. In one embodiment, the wall member 22 comprises a rectangular lateral cross-sectional configuration 40 and the wall member depth 30 comprises 4 inches as set forth in FIG. 7. The longitudinally-extending hollow metal tubes 34 may have any suitable wall member length 32, which in various embodiments may comprise a range from 12-22 feet, more particularly a range from 14-20 feet, and even more particularly a range from 14-18 feet. In one embodiment, the wall member 22 comprises a rectangular lateral cross-sectional configuration 40 and the wall member length 32 comprises 16 feet as set forth in FIG. 7. The wall members 22 may be spaced apart with any suitable spacing 45 and in one embodiment may be selected to be smaller than the width of the smallest person, even children, capable of walking, that could provide a threat to the persons or property housed within the predetermined perimeter, which in various embodiments may comprise a range from 3-9 inches, more particularly a range from 3-7 inches, and even more particularly a range from 3-5 inches. In one embodiment, the wall member 22 comprises a rectangular lateral cross-sectional configuration 40 and the spacing 45 comprises 4 inches as set forth in FIG. 7. Any number of wall members 22 may be incorporated into the mobile anti-scale wall section 10 and wall member module 12, which in various embodiments may comprise a range from 5-20 wall members, more particularly a range from 6-16 wall members, and even more particularly a range from 8-12 wall members. In one embodiment, the wall member 22 comprises a rectangular lateral cross-sectional configuration 40 and comprises 9 wall members as set forth in FIG. 7. In one embodiment, the number of wall members 22 (9) together with the wall member width 28 (4 inches) and wall member spacing 45 (4 inches) determine the total distance spanned by the wall members 22 of the mobile anti-scale wall section 10 of 68 inches.

The mobile anti-scale wall section 10 and wall member module 12 also comprises an outwardly facing anti-scale or anti-climb plate 46 comprising an anti-scale plate height 48 and an anti-scale plate width 50. The anti-climb plate 46 is attached to the plurality of spaced apart, longitudinally-extending wall members 22 proximate their upper wall ends 26 thereby joining the wall members 22 to one another. The anti-scale plate 46 may have any suitable shape, which in one embodiment comprises a rectangular shape. The anti-scale plate 46 may have any suitable anti-scale plate height 48, which in various embodiments may comprise a range from 3-6 feet, more particularly a range from 3-5 feet, and even more particularly a range from 3-4 feet. In one embodiment, the anti-scale plate height 48 comprises 38 inches as set forth in FIG. 7. The anti-scale plate 46 may have any suitable anti-scale plate width 50, which in various embodiments may be the same as or slightly greater than the total distance spanned by the plurality of wall members 22, and in one embodiment will be selected to extend beyond the wall members 22 at each of the opposed ends of the wall section 10 by one half of the spacing 45, and which in various embodiments may comprise a range from 3-12 feet, more particularly a range from 3-10 feet, and even more particularly a range from 3-8 feet. In one embodiment, the anti-scale plate width 50 comprises 6 feet as set forth in FIG. 7. The anti-scale plate 46 may be attached to the spaced apart longitudinally-extending wall members 22 using any suitable attachments, included attachment using a plurality of threaded bolts/nuts (not shown) that extend through corresponding bores in the wall members 22 and the anti-scale plate 46, or by a plurality of longitudinally-extending welds 52 that extend between the front facing corners 54 and the rear surface 56 of the anti-scale plate 46 (FIG. 3B). The anti-scale plate 46 may be made from any suitable material, and in one embodiment may comprise various metal alloys, including various alloys of steel, aluminum, or magnesium that have been given various combinations of heat and/or mechanical forming treatments to achieve predetermined microstructural, mechanical, chemical or physical properties. In one embodiment, the outwardly facing anti-scale or anti-climb plate 46 may be formed from the same material as the other components of the anti-scale wall section 10 and/or the wall member module 12.

Figure 14:
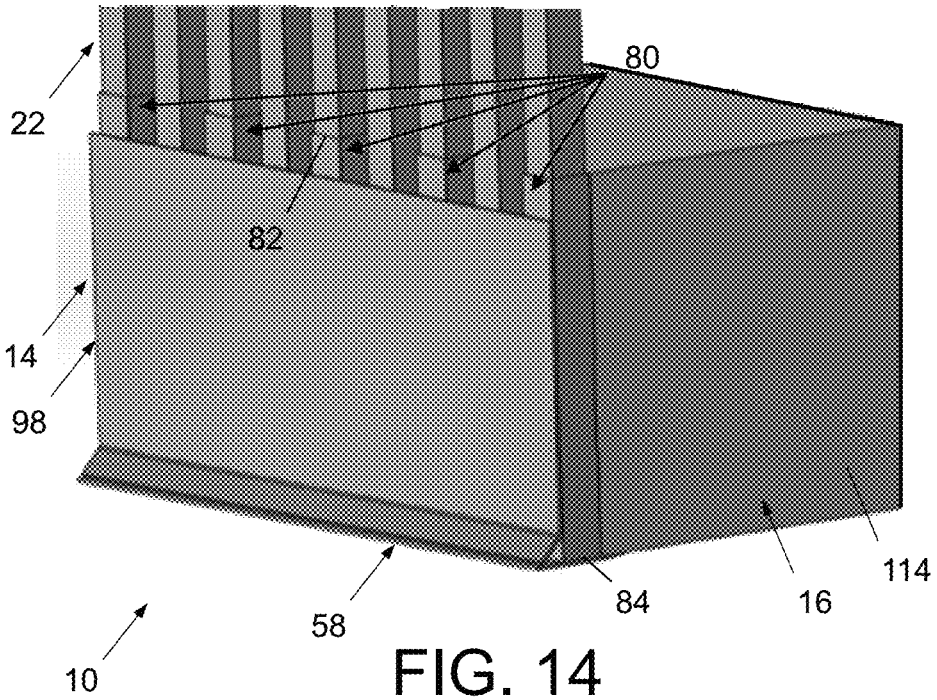
FIG. 14 is an enlarged front or outer perspective view of the embodiment of a mobile anti-scale wall section and concrete counterweight of FIG. 10.
Figure 16:
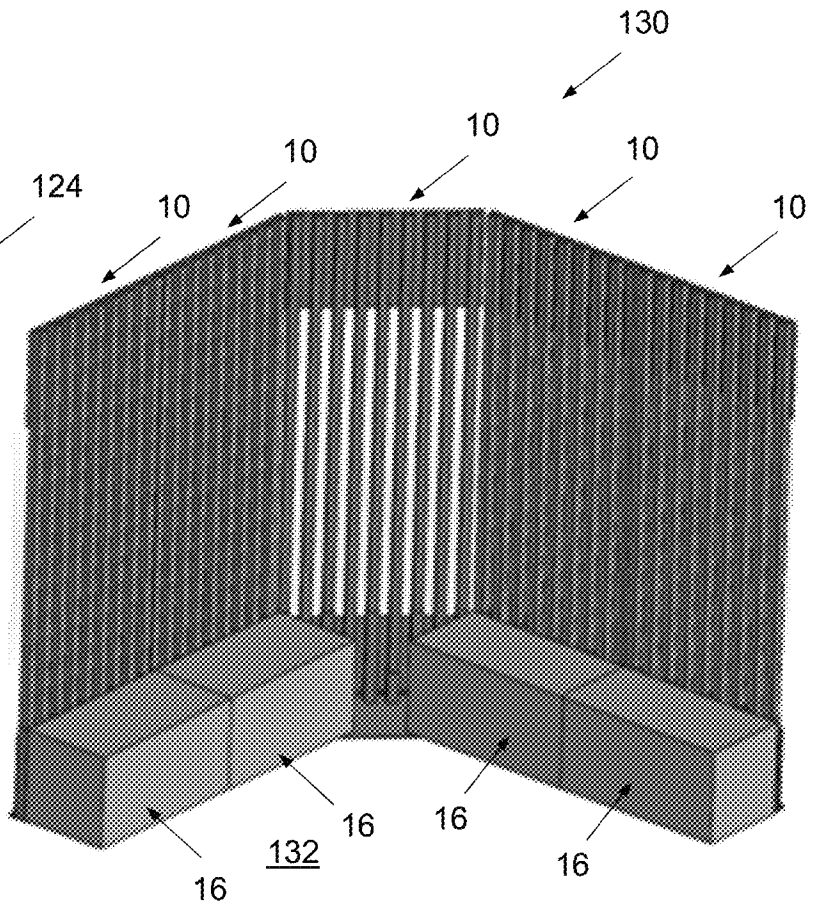
FIG. 16 is a rear or inner perspective view of the embodiment of a portion of a mobile anti-scale wall system of FIG. 15 comprising a plurality of adjoining mobile anti-scale wall sections and concrete counterweights.
Figure 15:
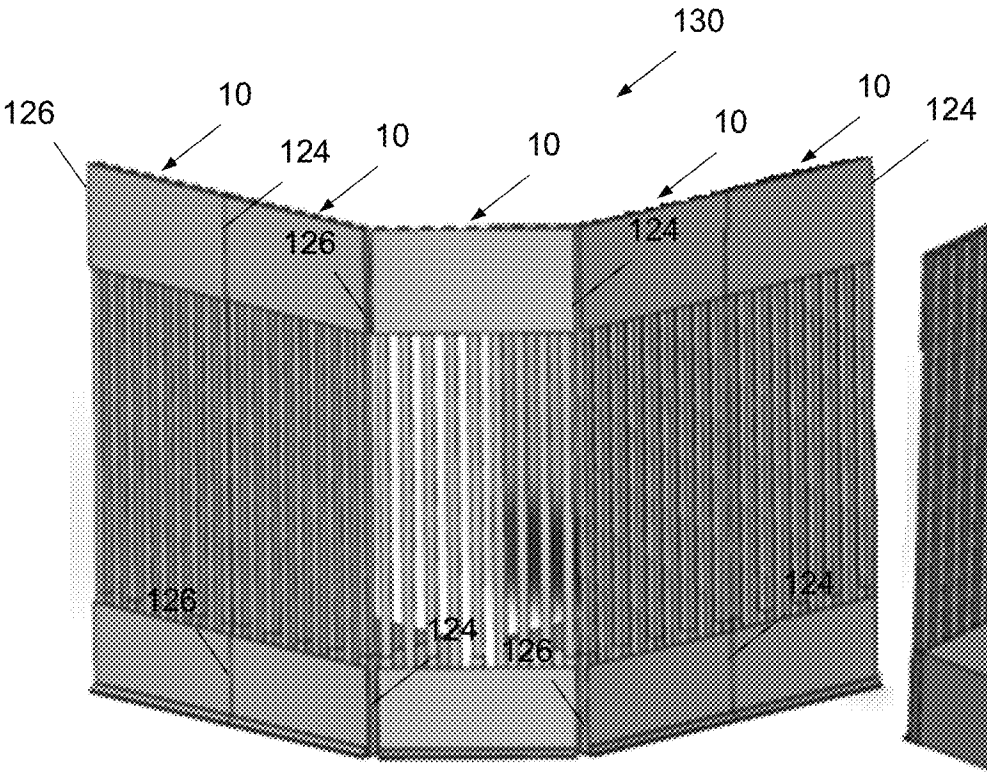
FIG. 15 is a front or outer perspective view of an embodiment of a portion of a mobile anti-scale wall system comprising a plurality of adjoining mobile anti-scale wall sections and concrete counterweights.
Figure 17:
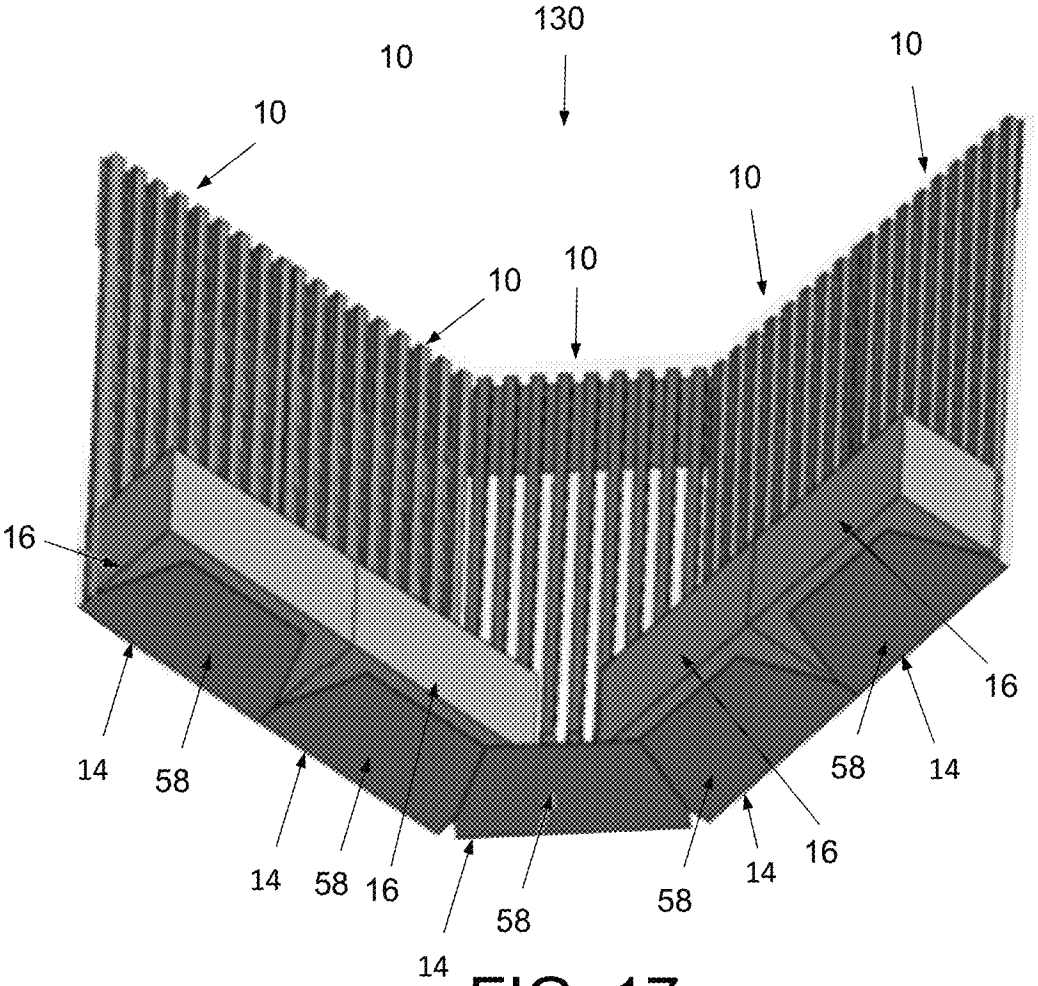
FIG. 17 is a bottom rear or inner perspective view of the embodiment of a portion of a mobile anti-scale wall system of FIG. 15 comprising a plurality of adjoining mobile anti-scale wall sections and concrete counterweights.

As shown in FIGS. 4 and 14, for example, the mobile anti-scale wall section 10 and base module 14 comprise a laterally-extending base plate 58 comprising an outer end 60 and an opposed inner end 62, the base plate configured for placement in a substantially horizontal position 63 (FIG. 3A) and configured to support the wall member module 12, including the wall members 22 and anti-scale plate 46. The laterally-extending base plate 58 may comprise any suitable size and shape or combination of shapes, including various rectangular and trapezoidal shapes and combinations thereof. In one embodiment, the laterally-extending base plate 58 may be configured for abutting engagement with, or partially abutting engagement with the adjoining laterally-extending base plates 58 of adjoining anti-scale wall sections 10 and base modules 12 to form a portion of a wall (e.g., FIG. 17). In one embodiment, the base plate 58 may comprise a combination of a rectangular shape portion 64 proximate the outer end 60 and an adjoining trapezoidal shape portion 66 with a base 68 that is coextensive with and extends from the long edge of the rectangle toward the opposed inner end 62, as illustrated, for example, in FIG. 4. In one embodiment, the rectangular shape portion 64 may have a length 70 and a width 72, where the length is substantially greater than the width. In one embodiment, the length 70 of the rectangular shape portion 64 may be the same as the anti-scale plate width 50 width, including the various ranges of width described herein and those of the embodiment set forth in FIG. 7. The rectangular shape portion 64 may have any suitable width 72, which in one embodiment is greater than or equal to the wall member depth 30 so that the rectangular shape portion 64 undergirds the plurality of spaced apart longitudinally-extending wall members 22, and in various embodiments may encompass the range of wall member depths 30 including the embodiment illustrated in FIGS. 4-7 where the width 72 is approximately 6-8 inches. The trapezoidal shape portion 66 may comprise any suitable trapezoidal form, including various acute, obtuse, and regular or isosceles trapezoidal forms having equal base angles. In one embodiment, the trapezoidal shape portion 66 comprises an isosceles trapezoidal form with a base angles 74 and 75 of (90°−22.5°=67.5°), which is well-suited to provide adjoining anti-scale wall sections 10 and base modules 14 that can be used to form a wall comprising both straight wall portions as wall corner portions that form a 45° angle to the straight wall portions as shown, for example, in FIGS. 14-17. The anti-scale plate 46 may be made from any suitable material, and in one embodiment may comprise various metal alloys, including alloys of carbon or stainless steel, aluminum, or magnesium that have been given various combinations of heat and/or mechanical forming treatments to achieve predetermined microstructural, mechanical, chemical or physical properties, including, for example, a predetermined yield strength, ultimate tensile strength, and/or hardness. In one embodiment, the laterally-extending base plate 58 may be formed from the same material as the other components of the anti-scale wall section 10 and/or the base module 14.

Figure 18A:
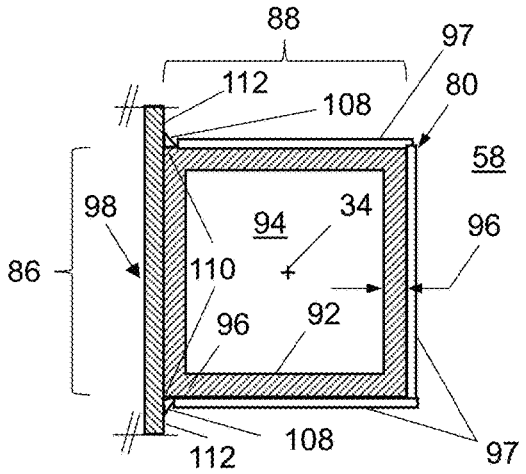
FIG. 18A is a section view of the embodiment of FIG. 6 taken along section 18A-18A
Figure 19A:
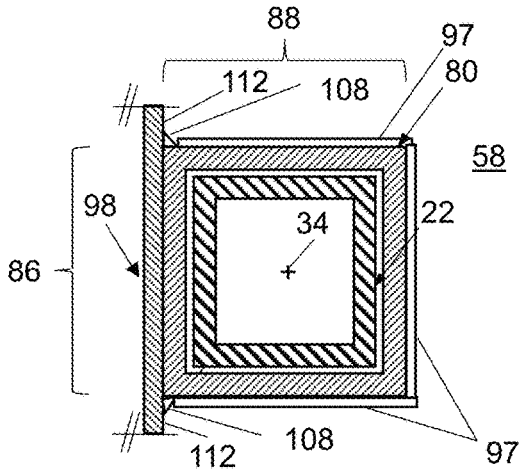
FIG. 19A is a section view of the embodiment of FIG. 3A taken along section 19A-19A
Figure 18B:
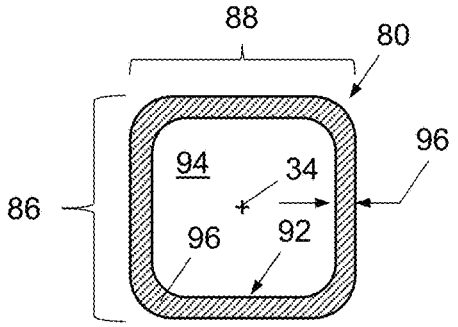
FIG. 18B is a section view of an alternate embodiment of FIG. 18A comprising wall members and receiving members comprising rounded rectangular cross-sectional shapes.
Figure 19B:
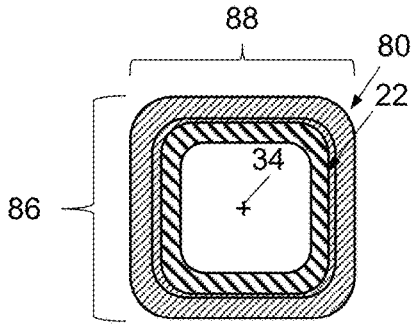
FIG. 19B is a section view of an alternate embodiment of FIG. 19A comprising wall members and receiving members comprising rounded rectangular cross-sectional shapes.
Figure 18C:
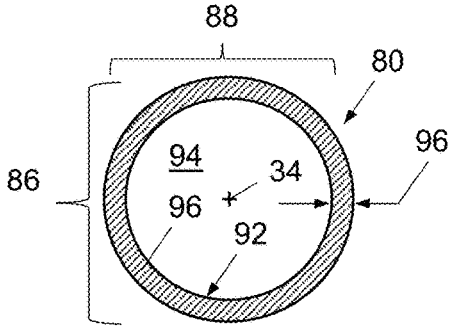
FIG. 18C is a section view of another alternate embodiment of FIG. 18A comprising wall members and receiving members comprising circular cross-sectional shapes.
Figure 19C:
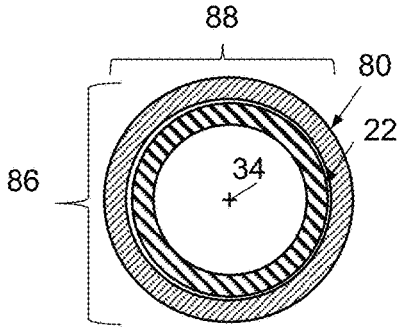
FIG. 19C is a section view of another alternate embodiment of FIG. 19A comprising wall members and receiving members comprising circular cross-sectional shapes.
Figure 20:
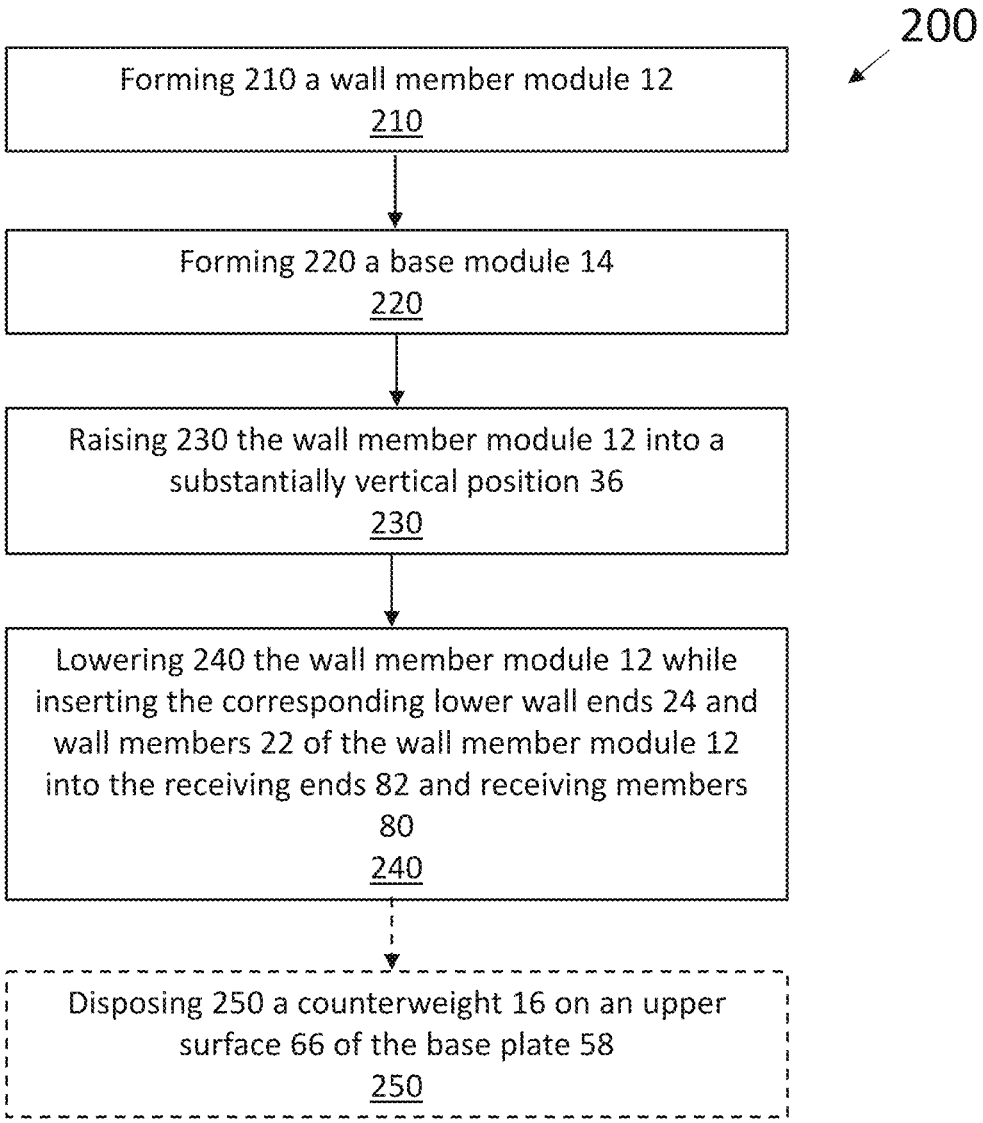
FIG. 20 is schematic flowchart of an embodiment of a method of making a mobile anti-scale wall section.
Figure 21:
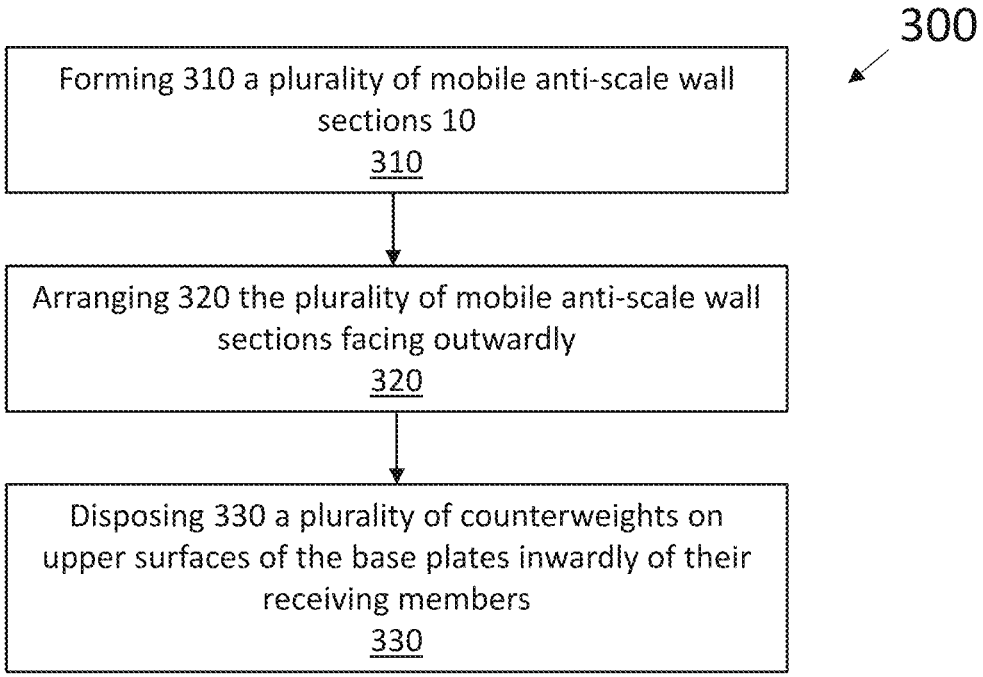
FIG. 21 is schematic flowchart of an embodiment of a method of using a mobile anti-scale wall section.

The mobile anti-scale wall section 10 and base module 14 also comprises a plurality of spaced apart, longitudinally-extending receiving members 80 corresponding to the plurality of spaced apart, longitudinally-extending wall members 22, each having an upper receiving end 82 and a lower receiving end 84 that is attached to the base plate 58 proximate the outer end 60, each upper receiving end 82 configured to receive a corresponding lower wall member end 24 in inserted engagement (e.g. FIGS. 19A-19C). The spaced apart, longitudinally-extending receiving members 80 also comprise a receiving member width 86 (e.g., FIGS. 18A-C) that faces forward/rearward, receiving member depth 88 that faces the left/right side or end/opposed end of the wall section, and a receiving member length 90 that extends along longitudinal axis 34, the receiving members are also configured for placement in a substantially vertical position 36. The plurality of spaced apart longitudinally-extending receiving members 80 may comprise any suitable receiving members formed from any suitable receiving member material. In one embodiment, the longitudinally-extending receiving members 80 comprise longitudinally-extending hollow metal tubes 92, such as tubes formed from various metal alloys, including alloys of carbon or stainless steel, aluminum, or magnesium that have been given various combinations of heat and/or mechanical forming treatments to achieve predetermined microstructural, mechanical, chemical or physical properties, including, for example, a predetermined yield strength, ultimate tensile strength, and/or hardness. In one embodiment, the plurality of spaced apart longitudinally-extending receiving members 80 may be formed from the same material as the other components of the anti-scale wall section 10 and/or the base module 14. The longitudinally-extending hollow metal receiving member tubes 92 may have any suitable lateral cross-sectional receiving configuration 94 as illustrated in FIGS. 18A-18C including, for example, rectangular (FIG. 18A), rounded rectangular (FIG. 18B), or circular (FIG. 18C) cross-sectional configurations. The longitudinally-extending hollow metal tubes 92 comprise a peripheral tube wall 96 that may have any suitable wall thickness 96, which in various embodiments may comprise a range from 0.03-1.0 inches, more particularly a range from 0.05-0.75 inches, and even more particularly a range from 0.10-0.50 inches. In one embodiment, the wall member 22 comprises a steel alloy and the wall thickness 44 comprises 0.125 inches as set forth in FIG. 7. The receiving member width 86 may comprise any suitable width, which in various embodiments may comprise a range from 3-9 inches, more particularly a range from 3-7 inches, and even more particularly a range from 3-5 inches. In one embodiment, the wall member 22 comprises a rectangular lateral cross-sectional configuration 40 and the receiving member width 28 comprises 4.5 inches as set forth in FIG. 7. The receiving member depth 88 may comprise any suitable depth, which in various embodiments may comprise a range from 3-9 inches, more particularly a range from 3-7 inches, and even more particularly a range from 3-5 inches. In one embodiment, the receiving member 80 comprises a rectangular lateral cross-sectional configuration 80 and the receiving member depth 88 comprises 4.5 inches as set forth in FIG. 7. The longitudinally-extending hollow metal receiving member tubes 92 may have any suitable receiving member length 90, which in various embodiments may comprise a range from 1-8 feet, more particularly a range from 1-6 feet, and even more particularly a range from 1-3 feet. In one embodiment, the receiving member 80 comprises a rectangular lateral cross-sectional receiving member configuration 94 and the receiving member length 90 comprises an alternating configuration of 3 foot and 1 foot receiving members 80 as set forth in FIGS. 3A-9. In one embodiment, the mobile anti-scale wall section 10 comprises spaced apart, longitudinally-extending receiving members each having a length 90 or height, and wherein the height of every other receiving member is different than the height of the immediately adjacent receiving member (e.g., FIGS. 6, 8, and 9), which in one embodiment may comprise a plurality of 3 foot long (5) and 1 foot long (4) receiving members.

The receiving members 80 may be spaced apart with any suitable receiving member spacing 95 that is configured to engage and receive the wall members 22 as described herein, which in various embodiments may comprise a range from 3-9 inches, more particularly a range from 3-7 inches, and even more particularly a range from 3-5 inches. In one embodiment, the wall member 22 comprises a rectangular lateral cross-sectional configuration 40 and the receiving member spacing 95 comprises 3.5 inches as set forth in FIG. 7. Any number of receiving members 80 may be incorporated into the mobile anti-scale wall section 10 and base module 12, which in various embodiments may comprise a range from 5-20 receiving members, more particularly a range from 6-16 receiving members, and even more particularly a range from 8-12 receiving members. In one embodiment, the receiving member 80 comprises a rectangular lateral cross-sectional receiving member configuration 94 and comprises 9 receiving members as set forth in FIG. 7. In one embodiment, the number of receiving members 80 (9) together with the receiving member width 28 (4.5 inches) and receiving member spacing 95 (3.5 inches) determine the total distance spanned by the receiving members 80 of the mobile anti-scale wall section 10 of 68.5 inches. In one embodiment, the receiving members 80 are disposed on the top surface 59 of the rectangular shape portion 64 of the laterally-extending base plate 58 and are attached to the rectangular shape portion 64 of the laterally-extending base plate 58. The receiving members 80 are attached to the rectangular shape portion 64 of the laterally-extending base plate 58, and may be attached by any suitable attachments, including bolt/nut attachments (not shown) and weld attachments comprising a plurality of peripheral welds 97 between the lower receiving ends 84 of the receiving members 80 and the base plate 58.

Figure 11:
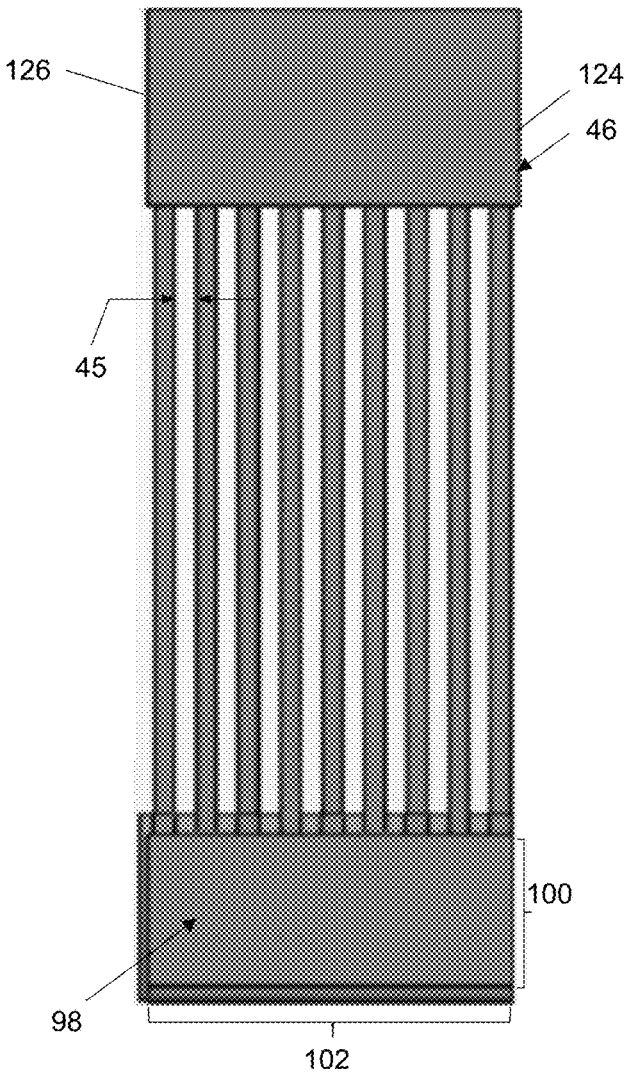
FIG. 11 is a front or outer view of the embodiment of the mobile anti-scale wall section and concrete counterweight of FIG. 10.
Figure 12:
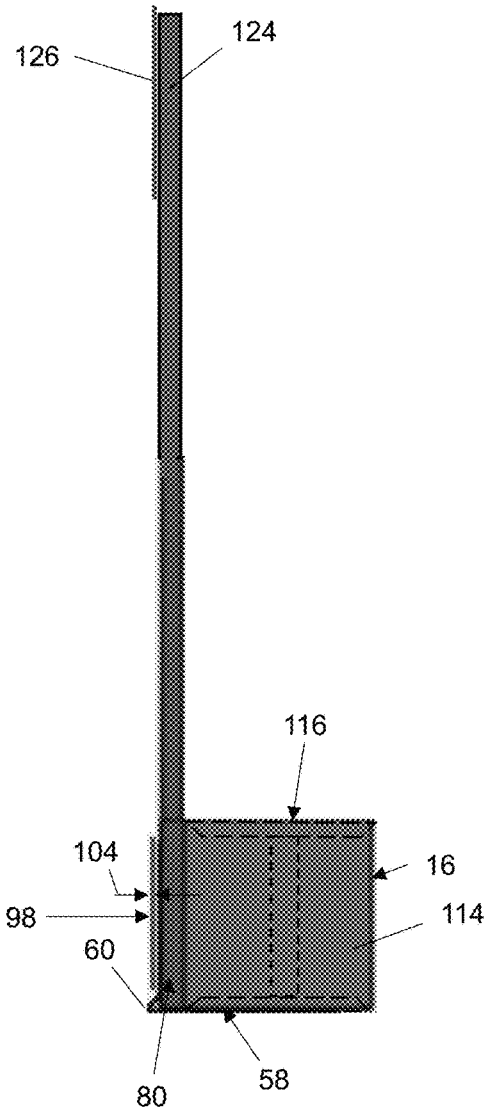
FIG. 12 is a right side view of the embodiment of a mobile anti-scale wall section and concrete counterweight of FIG. 10.
Figure 13:
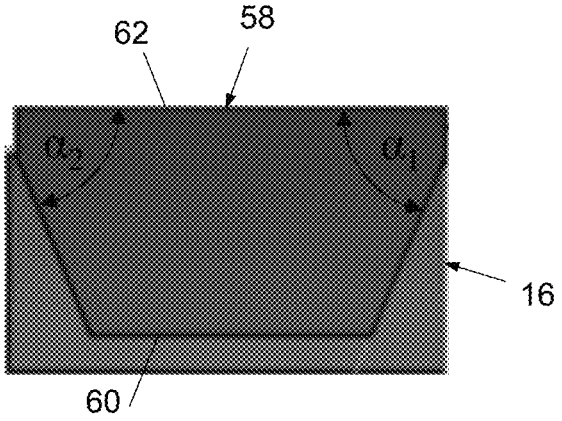
FIG. 13 is a bottom view of the embodiment of a mobile anti-scale wall section and concrete counterweight of FIG. 10 illustrating an embodiment of an inwardly tapered base.

The mobile anti-scale wall section 10 and base module 14 also comprises a longitudinally-extending kick plate 98 comprising a kick plate height 100 and a kick plate width 102 and a kick plate thickness 104 disposed on the base plate 58 proximate the outer end 60 and attached to the receiving members and/or the base plate as shown, for example, in FIGS. 11 and 12. In one embodiment, the kick plate 98 may be disposed on the base plate 58 by a laterally-extending weld 99 between them (e.g. FIGS. 5, 6, and 14). The longitudinally-extending kick plate 98 is attached to the plurality of spaced apart, longitudinally-extending receiving members 80 along their receiving member lengths 90 proximate their forward faces 101 by longitudinally-extending welds 108, thereby joining the receiving members 80 to one another. The kick plate 98 may have any suitable shape, which in one embodiment comprises a rectangular shape. The longitudinally-extending kick plate 98 may have any suitable kick plate height 100, which in various embodiments may comprise a range from 1-6 feet, more particularly a range from 2-5 feet, and even more particularly a range from 2.5-4 feet. In one embodiment, the longitudinally-extending kick plate 98 comprises approximately 30 inches as set forth in FIG. 7. The longitudinally-extending kick plate 98 may have any suitable kick plate width 102, which in various embodiments may be the same as or slightly greater than the total distance spanned by the plurality of receiving members 80, and in one embodiment will be selected to extend beyond the receiving members 80 at each of the opposed ends of the wall section 10 by one half of the spacing 95, and which in various embodiments may comprise a range from 3-12 feet, more particularly a range from 3-10 feet, and even more particularly a range from 3-8 feet. In one embodiment, the kick plate width 102 comprises 6 feet as set forth in FIG. 7. The longitudinally-extending kick plate 98 may be attached to the spaced apart longitudinally-extending receiving members 80 using any suitable attachments, included attachment using a plurality of threaded bolts/nuts (not shown) that extend through corresponding bores in the receiving members 80 and the kick plate 98, or by a plurality of longitudinally-extending welds 108 that extend between the front facing corners 110 and the rear surface 112 of the kick plate 98 (FIG. 18A). The kick plate 98 may be made from any suitable material, and in one embodiment may comprise various metal alloys, including various alloys of steel, including alloys of carbon or stainless steel, aluminum, or magnesium that have been given various combinations of heat and/or mechanical forming treatments to achieve predetermined microstructural, mechanical, chemical or physical properties, including, for example, a predetermined yield strength, ultimate tensile strength, and/or hardness. In one embodiment, the kick plate 98 may be formed from the same material as the other components of the anti-scale wall section 10 and/or the base module 14.

In one embodiment, the mobile anti-scale wall section 10 comprising the wall section module 12 and base module 14 further comprises a counterweight 16 (e.g., FIGS. 10-14) configured for disposition on the upper surface 59 of the base plate 58 inwardly of the receiving members 80 and comprising a weight configured to fix the mobile anti-scale wall section 10 in the upright position 36 with the wall members 22 in a substantially vertical position and in inserted engagement in the receiving members 80. The counterweight 16 may be formed from any suitable material and comprise any suitable size and shape, including having a size that is configured to cover the base plate 58. In one embodiment, the counterweight 16 comprises a concrete block 114 or steel member 116, such as a portion of a steel billet, or a portion or section of a steel I-beam. The counterweight 16 may have any suitable weight sufficient to fix the mobile anti-scale wall section 10 in the upright position 36, including in one embodiment a solid concrete block with a weight ranging from 3000-8000 lbs. and comprising a length of 6 feet, a width of 3 feet and a height of 3 feet.

Figure 9:
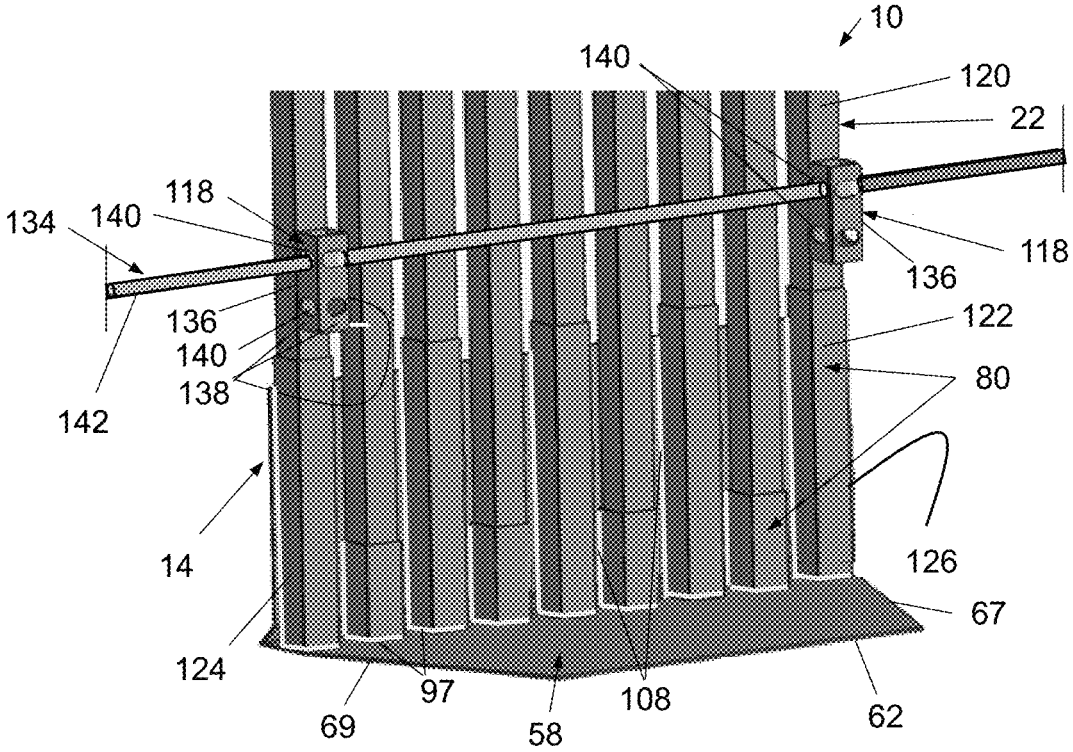
FIG. 9 is another enlarged rear perspective view of a lower portion of the mobile anti-scale wall system of FIG. 1 illustrating an embodiment of a plurality of spaced apart connecting members attached to bollards.
Figure 10:
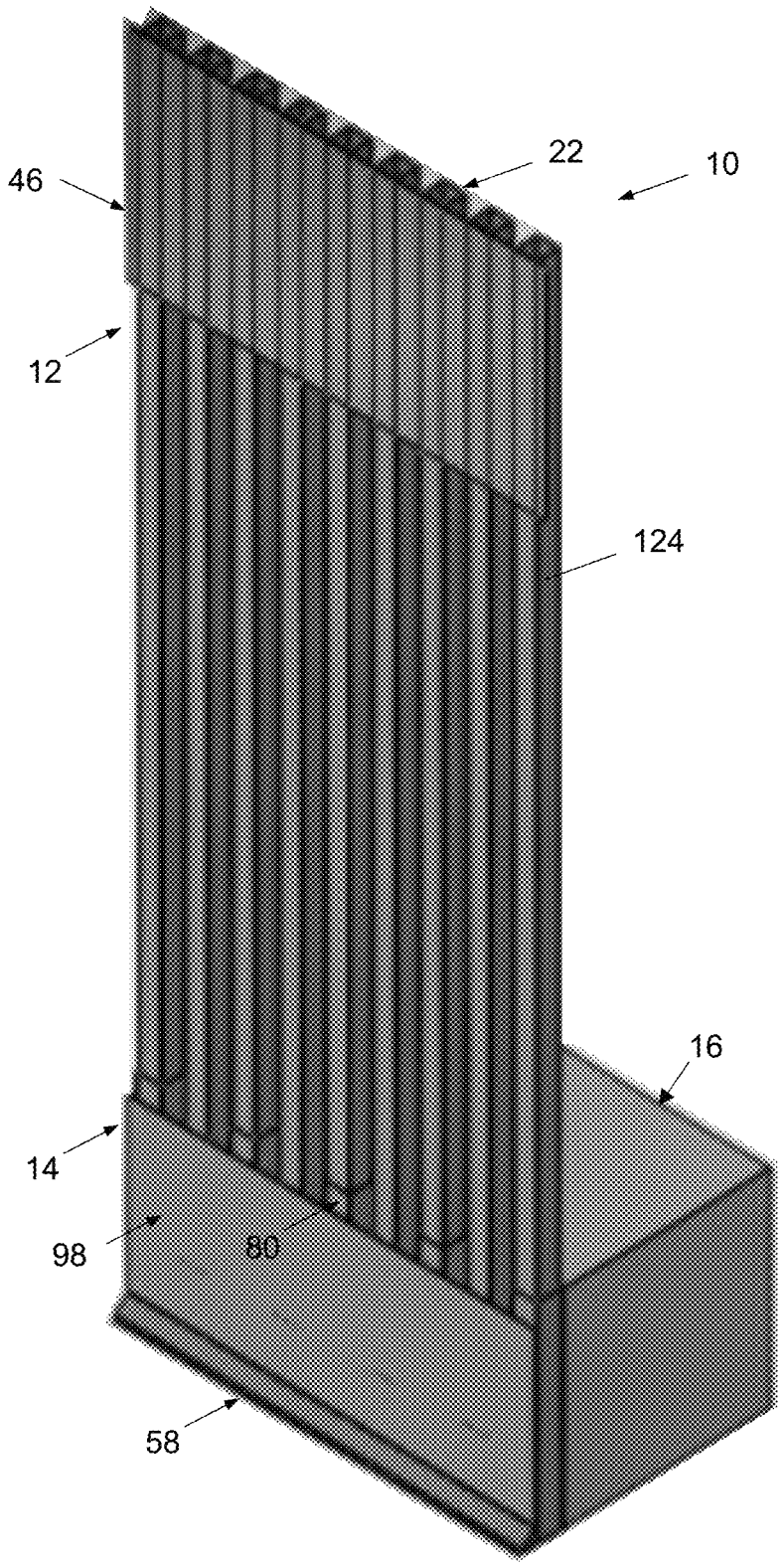
FIG. 10 is a front or outer perspective view of an embodiment of a mobile anti-scale wall section and concrete counterweight configured for use in a mobile anti-scale wall system, as described herein.

In one embodiment, the mobile anti-scale wall section 10 further comprises a plurality of connecting members 118 attached to inner wall member surfaces 120 of respective wall members 22 or inner receiving member surfaces 122 of respective receiving members 80 disposed proximate a first end 124 and an opposing second end 126 of the wall section (e.g., FIG. 9).

In one embodiment, the mobile anti-scale wall section 10 comprises a first end 124 and an opposed second end 126, and further comprises a plurality of wall sections 10 comprising respective first ends 124 and respective opposed second ends 126, the plurality of wall sections configured for disposition as a mobile anti-scale wall 130 with the first ends and opposing second ends of respective adjoining wall sections abutting one another. In one embodiment, the mobile anti-scale wall 130 comprising the plurality of wall sections 10 is configured to define an enclosed perimeter 132 having a predetermined perimeter shape, which may be any suitable predetermined perimeter shape, which in one embodiment may comprise a continuous mobile anti-scale wall 130 comprised entirely of mobile anti-scale wall sections 10 that by themselves define a completely enclosed perimeter and associated area. In another embodiment the mobile anti-scale wall 130 may be combined with other elements, such as buildings, or fences, or other fixed features of the terrain, or combinations thereof, to define a completely enclosed perimeter and associated area in combination with the other elements mentioned.

In one embodiment, the mobile anti-scale wall section 10 further comprises a plurality of connecting members 118 attached to inner wall member surfaces 120 of respective wall members or inner receiving member surfaces 122 of respective receiving members disposed proximate the first ends 124 and the opposing second ends 126 of the plurality of wall sections 10, wherein the connecting members are configured to receive a connector 134 that extends between and connects the respective ones of adjoining wall sections. In one embodiment, the connecting members 118 comprise hollow rectangular tube sections 136 as described herein with regard to the wall members 22, each tube section attached on one side to the inner surface 120 of the respective wall member and having three other exposed sides 138, the other exposed sides each having at least one bore 140 extending therethrough, at least one of the bores configured to receive the connector. In one embodiment, the mobile anti-scale wall section comprises a connector 134 comprising a threaded bolt and nut, or a tube, rod 142, cable, or chain that is configured to extend through at least one of the bores 140 of respective adjoining wall sections 10 to connect them to one another.

In one embodiment, the mobile anti-scale wall section 10 further comprises at least one lifting lug 144 attached to one of the spaced apart, longitudinally-extending wall members 22 or the anti-scale plate 46, and in certain other embodiments a plurality of lifting lugs that are spaced apart between the first end 124 and opposing second end 126. The lifting lugs 144 may comprise any suitable feature 146, such as a bore, for the attachment of lifting devices such as various cranes and lifts using various cables or chains as lifting means.

In one embodiment, the mobile anti-scale wall section 10 comprises vertically-extending wall members 22 comprise metal wall tubes 38 and the vertically-extending receiving members 80 comprise metal receiving tubes 92.

In one embodiment, the mobile anti-scale wall section 10 comprises the plurality of spaced apart, longitudinally-extending wall members 22 and the outwardly facing anti-scale plate 46 are assembled to form a wall member module 12 and the spaced apart, longitudinally-extending receiving members 80, base plate 58, and kick plate 98 are assembled to form a base module 14 as described herein.

In one embodiment, the mobile anti-scale wall section 10 comprises a base plate 58 comprising a tapered portion 148 that extends upwardly and inwardly from the outer end 60 to a tapered portion end 150, and wherein the kick plate 98 is disposed on the baseplate at the tapered portion end 150, a portion of the base plate below the tapered portion, or both.

In one embodiment, the base plate 58 comprises an inwardly-extending first side 67 and an inwardly-extending second side 69, and wherein the inwardly-extending first side and the inwardly-extending second side taper toward one another at a first predetermined angle ($\alpha_1$) and second predetermined angle ($\alpha_2$). In one embodiment, the first predetermined angle 74 ($\alpha_1$) and second predetermined angle 75 ($\alpha_2$) are equal, and in one embodiment, wherein the angles are both 67.5°.

Figure 8:
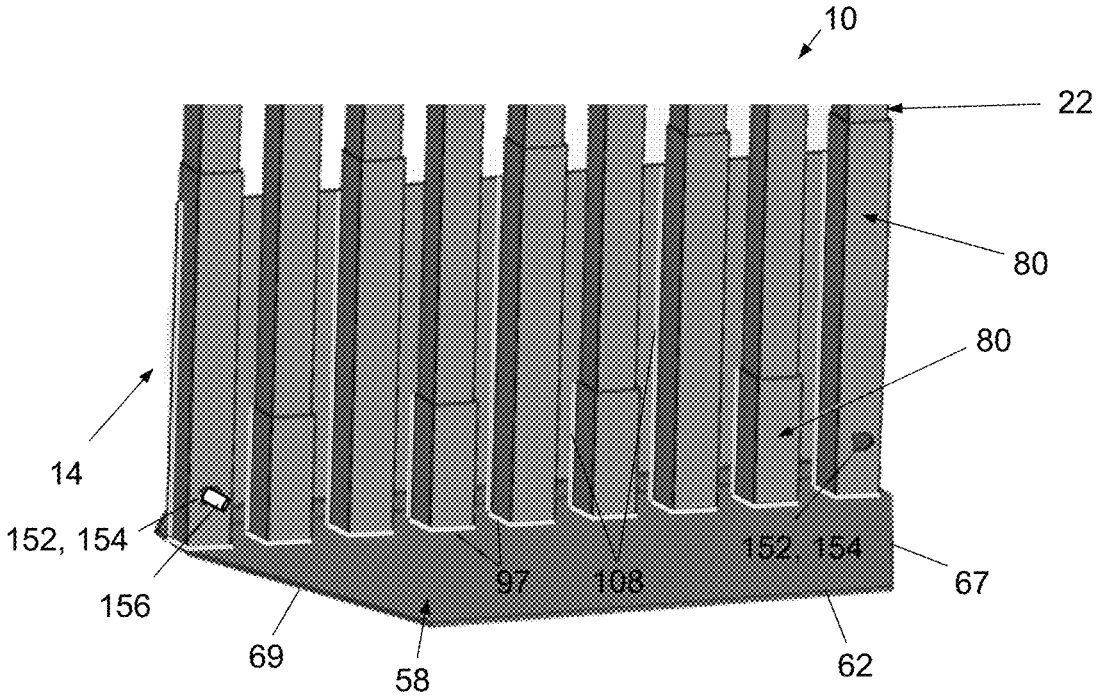
FIG. 8 is an enlarged rear perspective view of a lower portion of the mobile anti-scale wall system of FIG. 1 illustrating an embodiment of a plurality of staggered height receiving or female tubes attached to a base.

In one embodiment, the mobile anti-scale wall section 10 comprises at least one wall member 22 and corresponding receiving member 80 comprising adjoining wall locking feature 152 and receiving locking feature 154, such as adjoining bores, the wall locking feature and receiving locking feature configured to lock a wall member module 12 to a base module 14 by insertion of a locking member 156 such as a threaded bolt or pin (e.g., FIG. 8).

In one embodiment, a method of making 200 a mobile anti-scale wall section 10 is disclosed. The method of making a mobile anti-scale wall section 200 comprises: forming 210 a wall member module 12 comprising: a plurality of spaced apart longitudinally-extending wall members 22, each having a lower wall end 24, an upper wall end 26, a wall member width 28, and a length 32, the wall members configured for placement in a substantially vertical position 36; and an outwardly facing anti-scale plate 46 comprising an anti-scale plate height 48 and an anti-scale plate width 50 and attached to the plurality of spaced apart, longitudinally-extending wall members proximate their upper ends and joining the wall members to one another.

The method of making 200 the mobile anti-scale wall section 10 also comprises forming 220 a base module 14 comprising: a laterally-extending base plate 58 comprising an outer end 60 and an opposed inner end 62, the base plate configured for placement in a substantially horizontal position 63 and configured to support the wall members 22 and anti-scale plate 46; a plurality of spaced apart, longitudinally-extending receiving members 80 corresponding to the plurality of spaced apart, longitudinally-extending wall members, each having an upper receiving end 82 and a lower receiving end 84 that is attached to the base plate 58 proximate the outer end 60, each upper receiving end 82 configured to receive a corresponding lower wall end 24 in inserted and interlocking or nested engagement; and a longitudinally-extending kick plate 98 comprising a kick plate height 100 and a kick plate width 102 disposed on the base plate 58 proximate the outer end 60 and attached to the receiving members 80 and/or the base plate 58.

Figure 2:
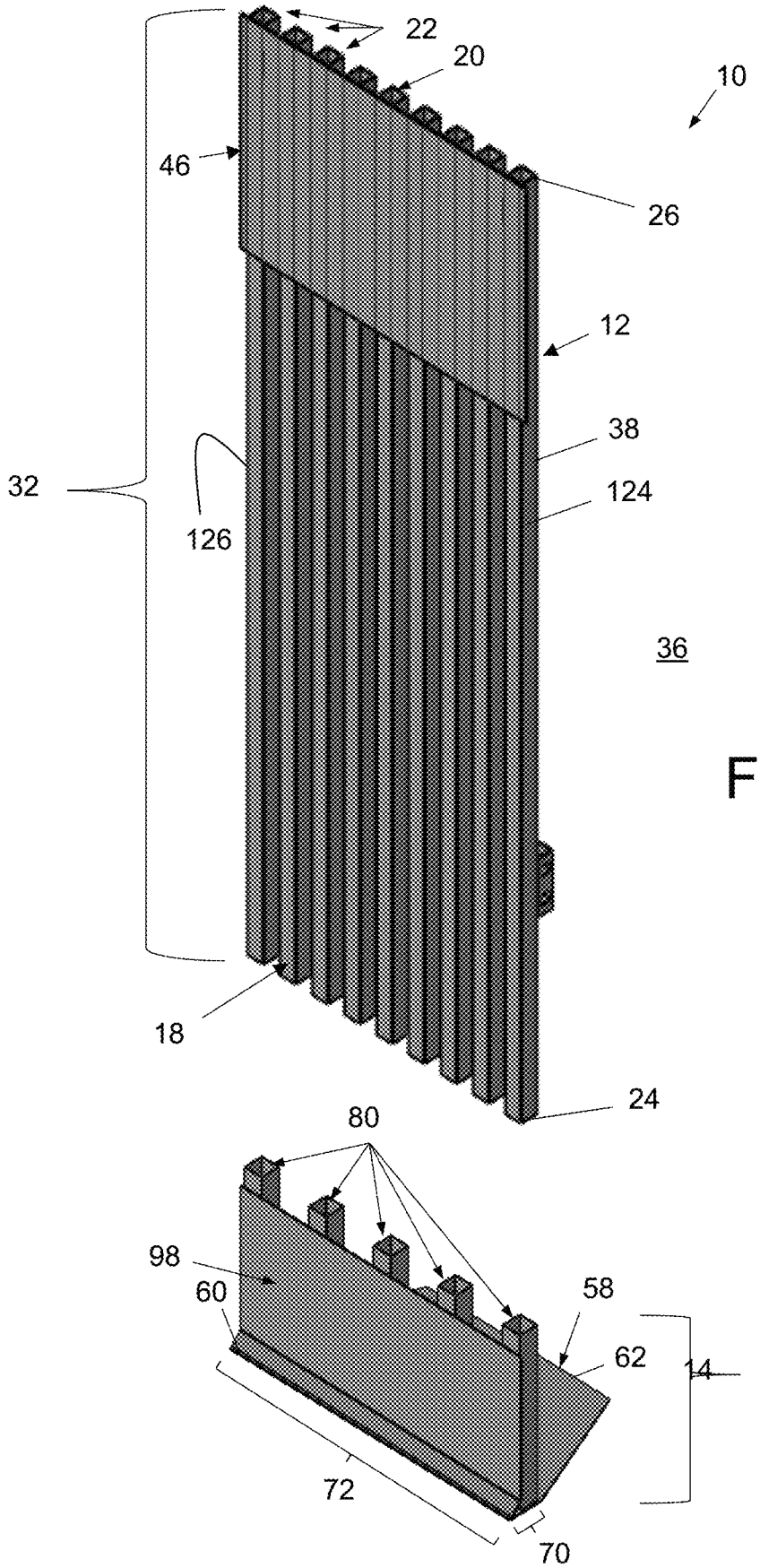
FIG. 2 is an exploded front or outer perspective view of the embodiment of FIG. 1 illustrating an embodiment of an upper or wall member module and a lower or base module in an unassembled condition.

The method of making 200 the mobile anti-scale wall section 10 also comprises raising 230 the wall member module 12 into a substantially vertical position 36 with the lower wall ends 24 disposed downwardly as shown in FIG. 2, for example.

The method of making 200 the mobile anti-scale wall section 200 also comprises lowering 240 the wall member module 12 while inserting the corresponding lower wall ends 24 and wall members 22 of the wall member module 12 into the receiving ends 82 and receiving members 80 of the base module 14 into inserted engagement to form the mobile anti-scale wall section 10.

In one embodiment, the method of making 200 the mobile anti-scale wall section, further comprises disposing 250 a counterweight 16 on an upper surface 66 of the base plate 58 inwardly of the receiving members 80 comprising a weight configured to fix the mobile anti-scale wall section 10 in an upright position 36 with the wall members 22 in a substantially vertical position 36 and in inserted engagement in the receiving members 80.

In one embodiment, a method of using 300 a mobile anti-scale wall section 10 to form a mobile anti-scale wall 130 comprises forming 310 a plurality of mobile anti-scale wall sections 10, each comprising: forming a wall member module 12 comprising: a plurality of spaced apart longitudinally-extending wall members 22, each having a lower wall end 24, an upper wall end 26, a wall member width 28, and a length 32, the wall members configured for placement in a substantially vertical position 36; and an outwardly facing anti-scale plate 46 comprising an anti-scale plate height 48 and an anti-scale plate width 50 and attached to the plurality of spaced apart, longitudinally-extending wall members proximate their upper ends and joining the wall members to one another; forming a base module 14 comprising: a laterally-extending base plate 58 comprising an outer end 60 and an opposed inner end 62, the base plate configured for placement in a substantially horizontal position 63 and configured to support the wall members and anti-scale plate; a plurality of spaced apart, longitudinally-extending receiving members 80 corresponding to the plurality of spaced apart, longitudinally-extending wall members, each having an upper receiving end 82 and a lower receiving end 84 that is attached to the base plate proximate the outer end 60, each upper receiving end configured to receive a corresponding lower wall end in inserted engagement; and a longitudinally-extending kick plate 98 comprising a kick plate height 100 and a kick plate width 102 disposed on the base plate proximate the outer end and attached to the receiving members and/or the base plate; raising the wall member module into a vertical position 36 with the lower wall ends disposed downwardly; and lowering the wall member module 12 while inserting the corresponding lower wall ends and wall members of the wall member module 14 into the receiving ends and receiving members of the base module into inserted engagement to form the mobile anti-scale wall section 10 comprising a first end 124 and an opposed second end 126.

The method of using 300 also comprises arranging 320 the plurality of mobile anti-scale wall sections 10 facing outwardly as each is formed with the first ends and opposing second ends of respective adjoining wall sections abutting one another to define a predetermined perimeter 132 having a predetermined perimeter shape.

The method of using 300 also comprises disposing 330 a plurality of counterweights on upper surfaces of the base plates inwardly of their receiving members, each comprising a weight configured to fix the mobile anti-scale wall sections in upright positions with the wall members in a substantially vertical positions and in inserted engagement in the receiving members, the mobile anti-scale wall sections and counterweights comprising a mobile anti-scale wall comprising the predetermined perimeter 132 having a predetermined perimeter shape.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of items is applied to all of the listed items, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the components or elements described herein specifically discloses and includes the embodiments that "consist essentially of" the named components (i.e., contain the named components and no other components that significantly adversely affect the basic and novel features disclosed), and embodiments that "consist of" the named components (i.e., contain only the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A mobile anti-scale wall section, comprising:

a plurality of spaced apart longitudinally-extending wall members, each having a lower wall member end, an upper wall member end, a wall member width, and a wall member length, the wall members configured for placement in a substantially vertical position;

an outwardly facing anti-scale plate comprising an anti-scale plate height and an anti-scale plate width and attached to the plurality of spaced apart, longitudinally-extending wall members proximate their upper wall member ends and joining the wall members to one another;

a laterally-extending base plate comprising an outer base end and an opposed inner base end, the base plate configured for placement in a substantially horizontal position and configured to support the wall members and anti-scale plate;

a plurality of spaced apart, longitudinally-extending receiving members corresponding to the plurality of spaced apart, longitudinally-extending wall members, each having an upper receiving member end and a lower receiving member end that is attached to the base plate proximate the outer base end, each upper receiving member end configured to receive a corresponding lower wall end in inserted engagement; and a longitudinally-extending kick plate comprising a kick plate height and a kick plate width disposed on the base plate proximate the outer base end and attached to the receiving members and/or the base plate.

2. The mobile anti-scale wall section of claim 1, further comprising a counterweight configured for disposition on an upper surface of the base plate inwardly of the receiving members and comprising a weight configured to fix the mobile anti-scale wall section in an upright position with the wall members in a substantially vertical position and in inserted engagement in the receiving members.

3. The mobile anti-scale wall section of claim 2, wherein the counterweight comprises a concrete block or steel member.

4. The mobile anti-scale wall section of claim 1, further comprising a plurality of connecting members attached to inner wall member surfaces of respective wall members or inner receiving member surfaces of respective receiving members disposed proximate a first end and an opposing second end of the wall section.

5. The mobile anti-scale wall section of claim 1, wherein the wall section comprises a first end and an opposed second end, further comprising a plurality of wall sections comprising respective first ends and respective opposed second ends, the plurality of wall sections configured for disposition as a mobile anti-scale wall with the first ends and opposing second ends of respective adjoining wall sections abutting one another.

6. The mobile anti-scale wall section of claim 5, wherein the mobile anti-scale wall comprising the plurality of wall sections is configured to define an enclosed perimeter.

7. The mobile anti-scale wall section of claim 5, further comprising a plurality of connecting members attached to inner wall member surfaces of respective wall members or inner receiving member surfaces of respective receiving members disposed proximate the first ends and the opposing second ends of the plurality of wall sections.

8. The mobile anti-scale wall section of claim 7, wherein the connecting members are configured to receive a connector that extends between and connects the respective ones of adjoining wall sections.

9. The mobile anti-scale wall section of claim 8, wherein the connecting members comprise hollow rectangular tube sections, each tube section attached on one side to the inner surface of the respective wall member and having three other exposed sides, the other exposed sides each having at least one bore extending therethrough, at least one of the bores configured to receive the connector.

10. The mobile anti-scale wall section of claim 8, wherein the connector comprises a threaded bolt and nut, or a tube, rod, cable, or chain that is configured to extend through at least one of the bores of respective adjoining wall sections to connect them to one another.

11. The mobile anti-scale wall section of claim 1, further comprising at least one lifting lug attached to one of the spaced apart, longitudinally-extending wall members or the anti-scale plate.

12. The mobile anti-scale wall section of claim 1, wherein the spaced apart, longitudinally-extending receiving members each have a length, and wherein the length of every other receiving member is different than the length of the immediately adjacent receiving member.

13. The mobile anti-scale wall section of claim 1, wherein the vertically-extending wall members comprise metal wall tubes and the vertically-extending receiving members comprise metal receiving tubes.

14. The mobile anti-scale wall section of claim 1, wherein the spaced apart, longitudinally-extending wall members and outwardly facing anti-scale plate are assembled to form a wall member module and the spaced apart, longitudinally-extending receiving members, base plate, and kick plate are assembled to form a base module.

15. The mobile anti-scale wall section of claim 1, wherein the base plate comprises a tapered portion that extends upwardly and inwardly from the outer end to a tapered portion end, and wherein the kick plate is disposed on the baseplate at the tapered portion end, a portion of the base plate below the tapered portion, or both.

16. The mobile anti-scale wall section of claim 1, wherein the base plate comprises an inwardly-extending first side and an inwardly-extending second side, and wherein the inwardly-extending first side and the inwardly-extending second side taper toward one another at a first predetermined angle ($\alpha_1$) and second predetermined angle ($\alpha_2$).

17. The mobile anti-scale wall section of claim 16, wherein the first predetermined angle ($\alpha_1$) and second predetermined angle ($\alpha_2$) are equal, and wherein the angle is 67.5°.

18. The mobile anti-scale wall section of claim 1, wherein at least one wall member and corresponding receiving member comprises an adjoining wall locking feature and receiving locking feature, the wall locking feature and receiving locking feature configured to lock a wall member module to a base module.

19. A method of making a mobile anti-scale wall section, comprising:

forming a wall member module comprising: a plurality of spaced apart longitudinally-extending wall members, each having a lower wall end, an upper wall end, a wall member width, and a length, the wall members configured for placement in a substantially vertical position; and an outwardly facing anti-scale plate comprising an anti-scale plate height and an anti-scale plate width and attached to the plurality of spaced apart, longitudinally-extending wall members proximate their upper ends and joining the wall members to one another;

forming a base module comprising: a laterally-extending base plate comprising an outer end and an opposed inner end, the base plate configured for placement in a substantially horizontal position and configured to support the wall members and anti-scale plate; a plurality of spaced apart, longitudinally-extending receiving members corresponding to the plurality of spaced apart, longitudinally-extending wall members, each having an upper receiving end and a lower receiving end that is attached to the base plate proximate the outer end, each upper receiving end configured to receive a corresponding lower wall end in inserted engagement; and a longitudinally-extending kick plate comprising a kick plate height and a kick plate width disposed on the base plate proximate the outer end and attached to the receiving members and/or the base plate;

raising the wall member module into a substantially vertical position with the lower wall ends disposed downwardly; and lowering the wall member module while inserting the corresponding lower wall ends and wall members of the wall member module into the receiving ends and receiving members of the base module into inserted engagement to form the mobile anti-scale wall section.

20. The method of making a mobile anti-scale wall section of claim 19, further comprising:

disposing a counterweight on an upper surface of the base plate inwardly of the receiving members comprising a weight configured to fix the mobile anti-scale wall section in an upright position with the wall members in a substantially vertical position and in inserted engagement in the receiving members.

21. A method of using a mobile anti-scale wall section to form a mobile anti-scale wall, comprising:

forming a plurality of mobile anti-scale wall sections, each comprising:

forming a wall member module comprising: a plurality of spaced apart longitudinally-extending wall members, each having a lower wall end, an upper wall end, a wall member width, and a length, the wall members configured for placement in a substantially vertical position; and an outwardly facing anti-scale plate comprising an anti-scale plate height and an anti-scale plate width and attached to the plurality of spaced apart, longitudinally-extending wall members proximate their upper ends and joining the wall members to one another;

forming a base module comprising: a laterally-extending base plate comprising an outer end and an opposed inner end, the base plate configured for placement in a substantially horizontal position and configured to support the wall members and anti-scale plate; a plurality of spaced apart, longitudinally-extending receiving members corresponding to the plurality of spaced apart, longitudinally-extending wall members, each having an upper receiving end and a lower receiving end that is attached to the base plate proximate the outer end, each upper receiving end configured to receive a corresponding lower wall end in inserted engagement; and a longitudinally-extending kick plate comprising a kick plate height and a kick plate width disposed on the base plate proximate the outer end and attached to the receiving members and/or the base plate;

raising the wall member module into a vertical position with the lower wall ends disposed downwardly;

lowering the wall member module while inserting the corresponding lower wall ends and wall members of the wall member module into the receiving ends and receiving members of the base module into inserted engagement to form the mobile anti-scale wall section comprising a first end and an opposed second end;

arranging the plurality of mobile anti-scale wall sections facing outwardly as each is formed with the first ends and opposing second ends of respective adjoining wall sections abutting one another to define a predetermined perimeter; and disposing a plurality of counterweights on upper surfaces of the base plates inwardly of their receiving members, each comprising a weight configured to fix the mobile anti-scale wall sections in upright positions with the wall members in a substantially vertical positions and in inserted engagement in the receiving members, the mobile anti-scale wall sections and counterweights comprising a mobile anti-scale wall comprising the predetermined perimeter.

* * * * *